US010995990B2

(12) United States Patent
Kosonsittiwit et al.

(10) Patent No.: US 10,995,990 B2
(45) Date of Patent: May 4, 2021

(54) ROTARY DRYER WITH MULTI-DRYING CHAMBERS

(71) Applicant: K.S. PREMIER PRODUCTS CO., LTD, Saraburi (TH)

(72) Inventors: Phakorn Kosonsittiwit, Sa Kaeo (TH); Sommas Keawluan, Songkhla (TH); Paisal Naksuk, Nonthaburi (TH); Thanakrit Kosonsittiwit, Saraburi (TH); Kriangkrai Chaisirinirun, Sa Kaeo (TH)

(73) Assignee: K.S. PREMIER PRODUCTS CO., LTD, Saraburi (TH)

( * ) Notice: Subject to any disclaimer, the term of this patent is extended or adjusted under 35 U.S.C. 154(b) by 301 days.

(21) Appl. No.: 16/065,725

(22) PCT Filed: Dec. 20, 2016

(86) PCT No.: PCT/TH2016/000100
§ 371 (c)(1),
(2) Date: Jun. 22, 2018

(87) PCT Pub. No.: WO2017/111710
PCT Pub. Date: Jun. 29, 2017

(65) Prior Publication Data

US 2018/0372409 A1 Dec. 27, 2018

(30) Foreign Application Priority Data

Dec. 22, 2015 (TH) ..... 1501007712

(51) Int. Cl.
*F26B 25/16* (2006.01)
*F26B 11/02* (2006.01)
(Continued)

(52) U.S. Cl.
CPC ..... *F26B 25/16* (2013.01); *F26B 11/028* (2013.01); *F26B 11/049* (2013.01); *F26B 11/0409* (2013.01); *F26B 17/32* (2013.01)

(58) Field of Classification Search
CPC ..... F26B 17/32; F26B 25/16; F26B 11/049; F26B 11/028; F26B 11/0409; F26B 9/085;
(Continued)

(56) References Cited

U.S. PATENT DOCUMENTS 109,903 A * 12/1870 Holloway et al. .. B01F 7/00991 366/280
205,178 A * 6/1878 Emmerich et al. ..... B68G 3/10 34/280
(Continued)

FOREIGN PATENT DOCUMENTS

JP 16010976 A 9/1941
JP 40000720 B1 1/1965
(Continued)

*Primary Examiner* — Edelmira Bosques
*Assistant Examiner* — Bao D Nguyen
(74) *Attorney, Agent, or Firm* — Troutman Pepper Hamilton Sanders LLP

(57) ABSTRACT

This invention relates to a rotary dryer with multi-drying chambers which is developed and improved for drying materials such as cassava chip, paddy, corn, various crops, longan, fertilizer, biomass and mining industry with better drying efficiency.

13 Claims, 10 Drawing Sheets

(51) Int. Cl.
*F26B 11/04* (2006.01)
*F26B 17/32* (2006.01)

(58) Field of Classification Search
CPC .... F26B 11/0477; F26B 15/085; F26B 25/04; F27B 7/04; F27B 7/28; E01C 19/1036; E01C 2019/1095
USPC ..... 34/108, 179, 236, 500, 616
See application file for complete search history.

(56) References Cited

U.S. PATENT DOCUMENTS 1,561,166 A * 11/1925 Jonsson ..... F26B 11/049 34/92
1,573,144 A * 2/1926 Credo ..... F26B 11/028 34/423
1,959,061 A * 5/1934 Perkins ..... F26B 11/028 432/107
2,162,973 A * 6/1939 Roland ..... F26B 11/028 34/134
2,165,128 A * 7/1939 Cheesman ..... F27B 7/04 432/48
2,213,667 A * 9/1940 Dundas ..... F26B 11/028 110/220
2,253,098 A * 8/1941 Schneider ..... F27B 7/24 34/130
2,354,567 A * 7/1944 Adt ..... F26B 11/026 34/134
2,483,630 A * 10/1949 Erisman ..... F26B 11/028 34/135
2,504,156 A * 4/1950 Ronne ..... F26B 11/0409 366/229
2,537,379 A * 1/1951 Teeman ..... F26B 11/028 34/599
2,581,756 A * 1/1952 Erisman ..... F26B 11/028 34/135
2,653,393 A * 9/1953 Bojner ..... F26B 11/0409 34/137
2,666,633 A * 1/1954 Bojner ..... F26B 11/0409 34/137
2,705,842 A * 4/1955 Vincent ..... F26B 1/00 34/102
2,810,968 A * 10/1957 Pitt ..... F26B 11/0477 34/109
2,818,657 A * 1/1958 Wolfe ..... F26B 11/028 34/109
2,840,922 A * 7/1958 Erisman ..... F28C 3/18 34/135
2,884,229 A * 4/1959 Francis ..... F28D 11/04 165/88
3,136,611 A * 6/1964 Wright ..... F26B 11/0404 34/63
3,169,016 A * 2/1965 Schneider ..... F26B 11/0409 34/137
3,175,815 A * 3/1965 Wicken et al. ..... F26B 11/0409 34/137
3,227,430 A * 1/1966 Vaughan, Jr. ..... F27B 7/04 432/116
3,245,154 A * 4/1966 Bojner ..... F26B 11/0409 34/142
3,430,936 A * 3/1969 Metzger ..... F27B 7/04 165/88
3,845,941 A * 11/1974 Mendenhall ..... E01C 19/1036 366/24
3,971,666 A * 7/1976 Mendenhall ..... E01C 19/1036 106/281.1
3,975,002 A * 8/1976 Mendenhall ..... E01C 19/1036 366/7
4,000,000 A * 12/1976 Mendenhall ..... B01F 15/066 106/280
4,106,110 A * 8/1978 Mendenhall ..... E01C 19/1036 366/147
4,142,803 A * 3/1979 Mendenhall ..... E01C 19/1036 34/131
4,189,238 A * 2/1980 Mendenhall ..... E01C 19/1036 106/284.01
4,207,062 A * 6/1980 Moench ..... E01C 19/1036 366/25
4,427,376 A * 1/1984 Etnyre ..... E01C 7/267 366/25
4,481,039 A * 11/1984 Mendenhall ..... E01C 19/1036 106/281.1
RE31,904 E * 6/1985 Mendenhall ..... B01F 15/063 366/25
RE31,905 E * 6/1985 Mendenhall ..... C08L 95/00 106/281.1
4,639,217 A * 1/1987 Adams ..... F27B 7/04 110/226
4,797,002 A * 1/1989 Heap ..... E01C 19/1036 366/228
5,054,931 A * 10/1991 Farnham ..... E01C 19/1036 366/25
5,330,351 A * 7/1994 Ransom, Jr. ..... F27B 7/04 432/103
6,267,493 B1 * 7/2001 Swisher, Jr. ..... E01C 19/1036 34/137
2012/0131812 A1 * 5/2012 Mammoli ..... E01C 19/1036 34/108
2012/0132640 A1 * 5/2012 Mammoli ..... E01C 19/1036 219/389
2012/0132641 A1 * 5/2012 Mammoli ..... E01C 19/1036 219/389

FOREIGN PATENT DOCUMENTS

JP 7159035 A 6/1995
JP 2007263481 A 10/2007
JP 2013217588 A 10/2013
KR 20110067072 A 6/2011

* cited by examiner

A

B

ROTARY DRYER WITH MULTI-DRYING CHAMBERS

FIELD OF THE INVENTION

This invention is in a field of an engineering relating to a rotary dryer with multi-drying chambers.

BACKGROUND OF THE INVENTION

Rotary dryers are currently used for drying of ore, wood chip, fertilizer, nut and other crops. The rotary dryer is usually designed to have its drying drum being in an inclined horizontal axis to let moist material flow in at one side and dried material flow out at the other side. Commonly, the drying medium is hot gas or hot air controlled to flow in either the same direction or counter direction with material flow direction. However, sometimes it is designed to have transverse flow (hot gas or hot air flows in a transverse direction with material flow direction). In general, rotary dryers have mixed drying aspects between flash dryer and tray dryer by using heat conduction of rotary drum wall and heat convection of hot gas flow. The said dryers have various limitations such as the drying rate falls off after some moisture of the material has been removed, problems with drying time and drying cost, etc. An alternative method for improving the drying rate is to increase the temperature of hot gas used in the drying, increase the contacting surface area between hot gas and material and manage hot gas in the drying chamber to allow hot gas evenly contact with the material, so that the dried material is uniformly dried using less drying time, also quality of the dried material meets the drying standard. Although the efficiency of drying is direct variation with the temperature of the drying gas, too high temperature may cause negative results in burning, cracking or over drying of the material.

As from the study of the above-mentioned dryers, such as the dryers for cassava chip, paddy, corn, various crops, biomass and ore, there have been no disclosure of a rotary dryer with multi-drying chambers particularly the dryer with hot gas flows in a direction that is the same or counter with material flow direction which is able to dry cassava chip, paddy, corn, various crops, longan, biomass and ore using less drying time.

SUMMARY OF THE INVENTION

This invention relates to a rotary dryer with multi-drying chambers with an improvement for using in various drying industries such as drying of agricultural products that are cassava chip, paddy, corn, various crops, longan, biomass and mining industry with better drying efficiency.

The rotary dryer with multi-drying chambers according to this invention is novel invented for a purpose to develop drying industries, such as drying of agricultural products that are cassava chip, paddy, various crops, longan, fertilizer, biomass and mining industry. The rotary dryer with multi-drying chambers according to this invention comprises a base frame, a drive assembly installed on the base frame, in which the drive assembly comprises a motor and a plurality of rollers, a drying chamber assembly having a moist material inlet part at one end and a dried material outlet part at the other end, in which the moist material inlet part and the dried material outlet part are installed on the rollers of the drive assembly, a moist material inlet assembly capped to the moist material inlet part and installed on the base frame, a dried material outlet assembly capped to the dried material outlet part and installed on the base frame and a housing encompassed the drying chamber assembly and installed on the base frame, characterized in that the drying chamber assembly comprises a plurality of drying chambers formed from an axial core, a plurality of drying chamber partition walls installed around the axial core and a plurality of drying chamber enclosure walls fixed to the plurality of drying chamber partition walls, in which a plurality of material flow control assemblies is provided in each of the plurality of drying chambers.

An objective of this invention is to improve a rotary dryer with multi-drying chambers in order to obtain better drying efficiency, such as to increase the drying capacity, to reduce the drying time, to give benefit to farmers by reducing the drying cost and to give benefit to various drying industries such as drying of agricultural products that are cassava chip, paddy, corn, various crops, longan, fertilizer, biomass and mining industry.

DETAILED DESCRIPTION OF THE INVENTION

Figure 1:
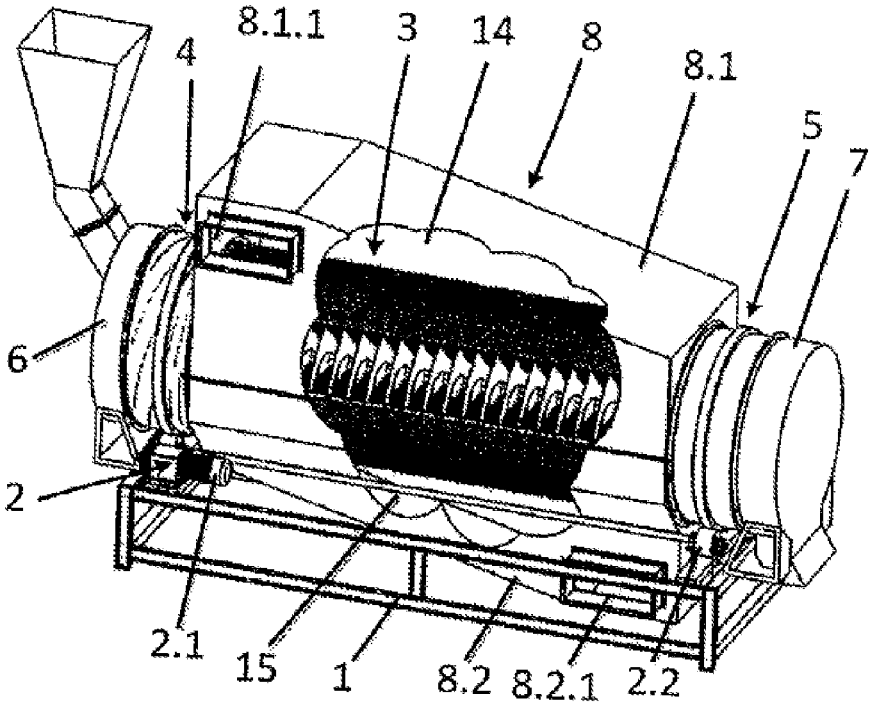
FIG. 1 shows a perspective view of the rotary dryer with multi-drying chambers according to this invention.
Figure 2:
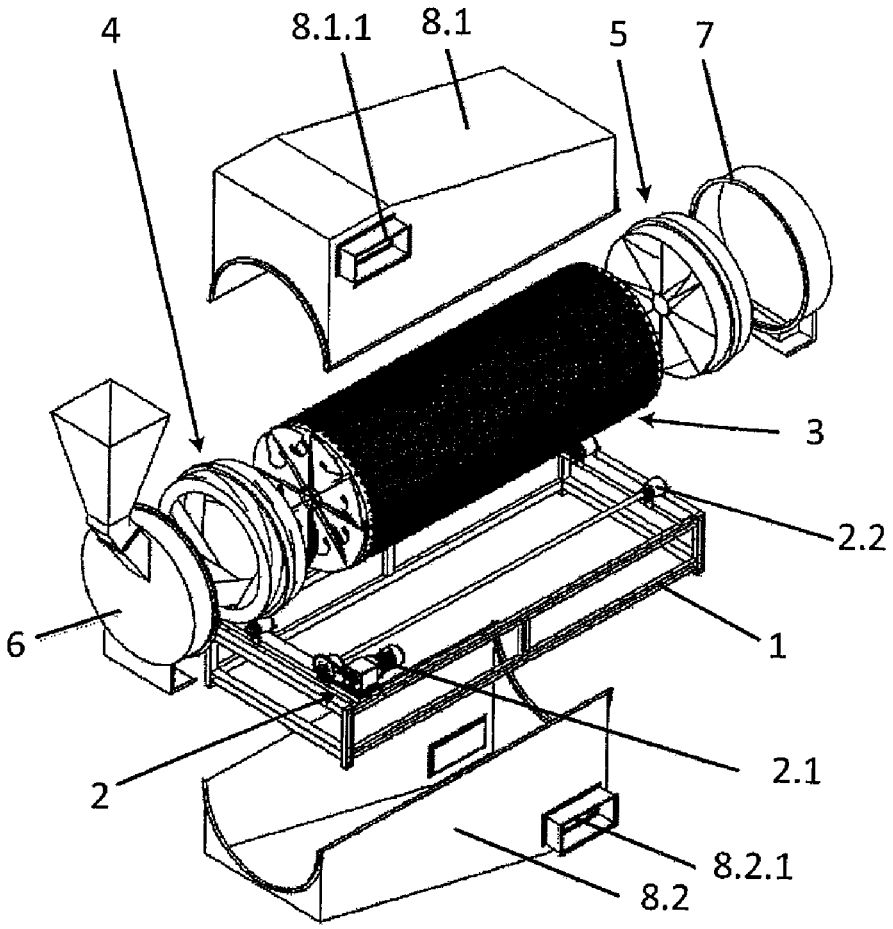
FIG. 2 shows an exploded view of the rotary dryer with multi-drying chambers according to this invention.

FIGS. 1 to 12 show a rotary dryer with multi-drying chambers and its components according to this invention.

As shown in the figures, the rotary dryer with multi-drying chambers according to this invention comprises a base frame 1, a drive assembly 2 installed on the base frame 1, in which the drive assembly 2 comprises a motor 2.1 and a plurality of rollers 2.2, a drying chamber assembly 3 having a moist material inlet part 4 at one end and a dried material outlet part 5 at the other end, in which the moist material inlet part 4 and the dried material outlet part 5 are installed on the rollers 2.2 of the drive assembly 2, a moist material inlet assembly 6 capped to the moist material inlet part 4 and installed on the base frame 1, a dried material outlet assembly 7 capped to the dried material outlet part 5 and installed on the base frame 1 and a housing 8 encompassed the drying chamber assembly 3 and installed on the base frame 1. The rotary dryer with multi-drying chambers according to this invention characterizes in that the drying chamber assembly 3 comprises a plurality of drying chambers 9 formed from an axial core 10, a plurality of drying chamber partition walls 11 installed around the axial core 10 and a plurality of drying chamber enclosure walls 12 fixed to the plurality of drying chamber partition walls 11, in which a plurality of material flow control assemblies 13 is provided in each of the plurality of drying chambers 9.

According to the above embodiment, the drying chamber assembly 3 comprising the plurality of drying chambers 9 gives an advantage that moist materials can widely spread through each drying chamber, hot gas can flow through the material, contact surface area between hot gas and the material is also increased, the moisture exchange can perform efficiently and the drying can perform rapidly. Also, widely flow of the material in the drying chambers results in balance rotation of the drying chamber assembly 3 and the energy used is less than the conventional rotary dryer with single drying chamber.

Figure 6:
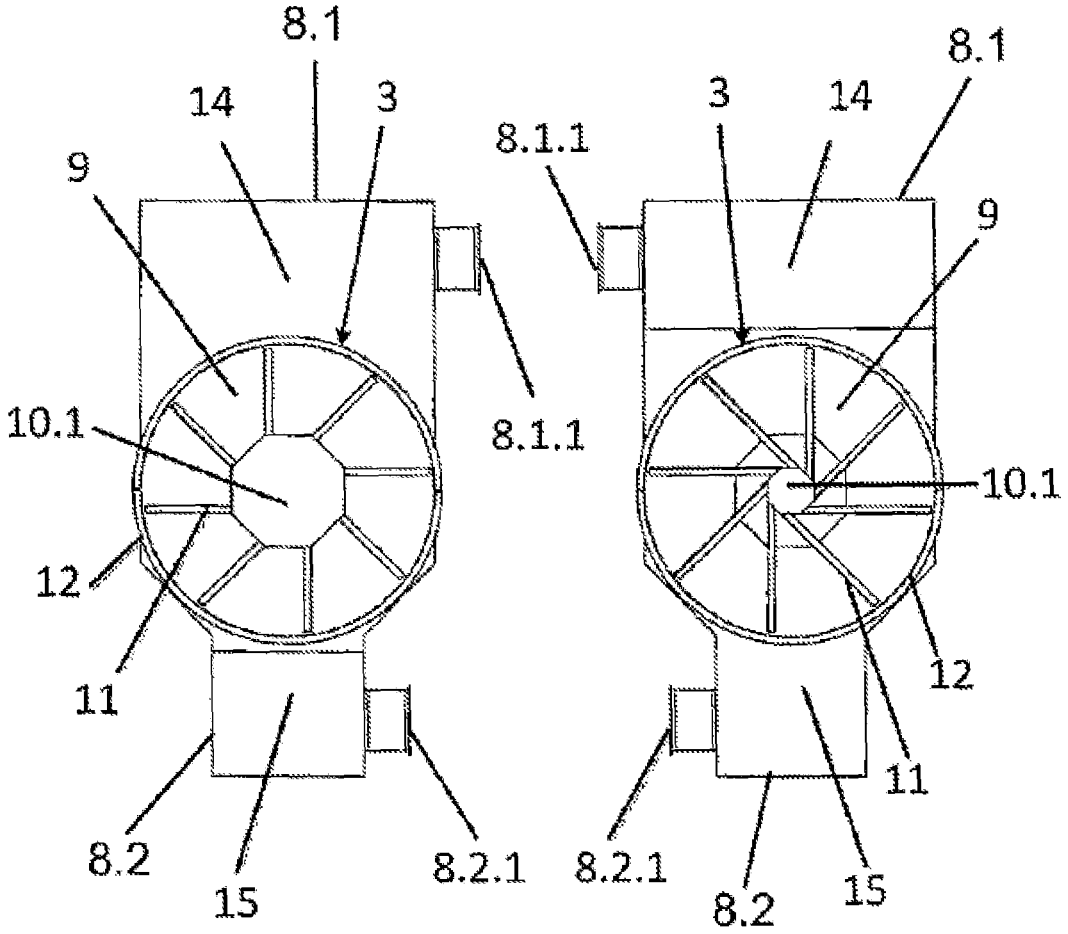
FIG. 6 shows front and rear cross-sectional views of the rotary dryer with multi-drying chambers illustrating an embodiment of the axial core with tapered geometry cross-sectional surface areas according to this invention.

According to this invention, the axial core 10 has a rod shape with tapered geometry cross-sectional surface areas 10.1 (as shown in FIGS. 6 and 8A) suitable for hardly flow materials such as the materials with sheet, stick or stripe-liked shapes, for example, cassava chip, chilli, corn, etc. The axial core 10 with tapered geometry cross-sectional surface areas results in inclination of the walls of the plurality of drying chambers 9, so giving an advantage to the operation of the material flow control assembly 13 in such a way that hardly flow material can flow easier without a need to install the drying chamber assembly 3 in an inclined manner that one side is higher than the other side as seen in the conventional rotary dryer with single drying chamber.

Figure 7:
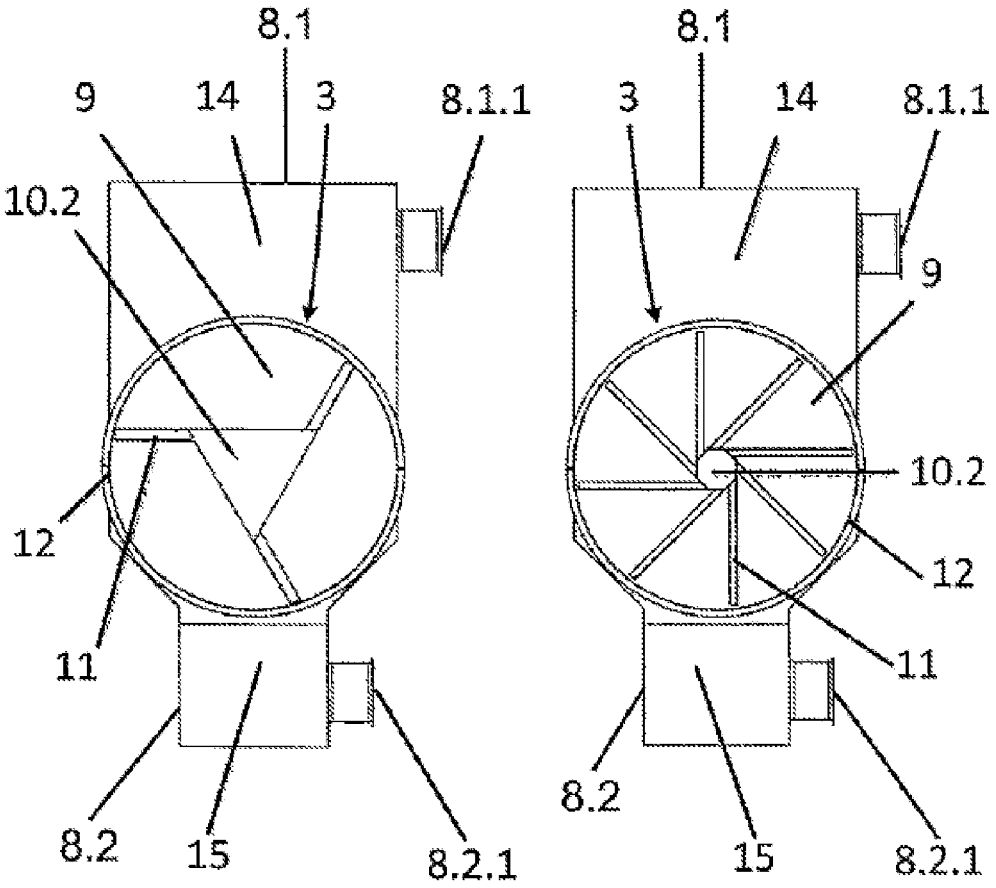
FIG. 7 shows front cross-sectional views of the rotary dryer with multi-drying chambers illustrating an embodiment of the axial core with constant geometry cross-sectional surface areas according to this invention.

According to this invention, the axial core 10 has a rod shape with constant geometry cross-sectional surface areas 10.2 (as shown in FIGS. 7 and 8B) suitable for easily flow materials such as the materials with granular or spherical shapes, for example, corn seed, bean seed, longan, etc. The operation of the material flow control assembly 13 also gives an advantage in better flow of easily flow material.

According to this invention, the plurality of drying chambers 9 which is preferably has at least three chambers being around the axial core 10 (as shown in FIGS. 6 and 7). This embodiment gives an advantage that the moist materials are able to widely spread through each drying chamber around the axial core 10, resulting in balance rotation of the drying chamber assembly 3 and the energy used for rotation is less than the conventional rotary dryer with single drying chamber. Also, the number of drying chambers can be designed to be proper with a size of the drying chamber assembly 3 and proper with morphologies of the moist materials that may vary in their big-small, long-short and thin-thick shapes.

Figure 3:
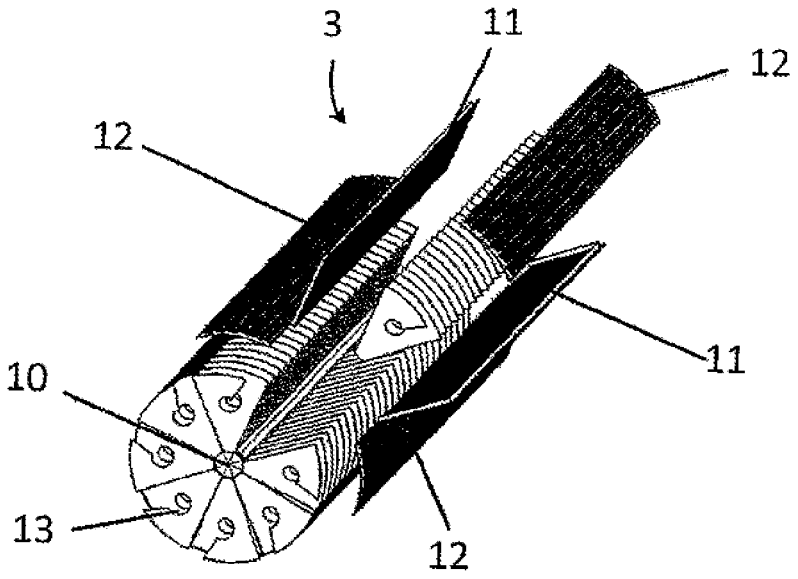
FIG. 3 shows a perspective and partially exploded view of the drying chamber assembly according to this invention.

According to this invention, each of the plurality of drying chamber partition walls 11 is shaped as a rectangular wall, in which a number of the plurality of drying chamber partition walls 11 is equal to a number of the plurality of drying chambers 9 (as shown in FIG. 3).

Figure 9:
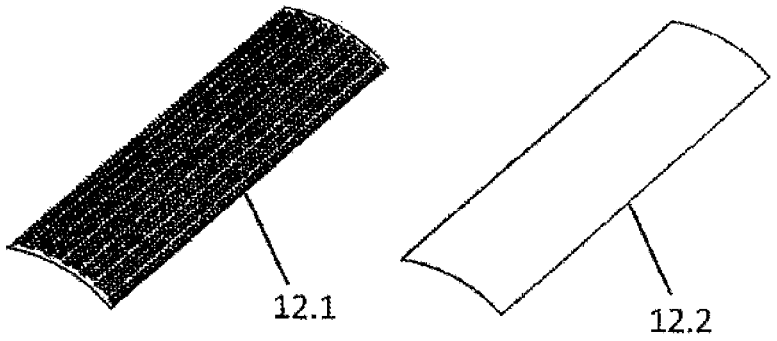
FIG. 9 shows perspective views of a plurality of drying chamber enclosure walls according to this invention in various embodiments that are a porous and curved rectangular wall and a solid and curved rectangular wall.
Figure 10:
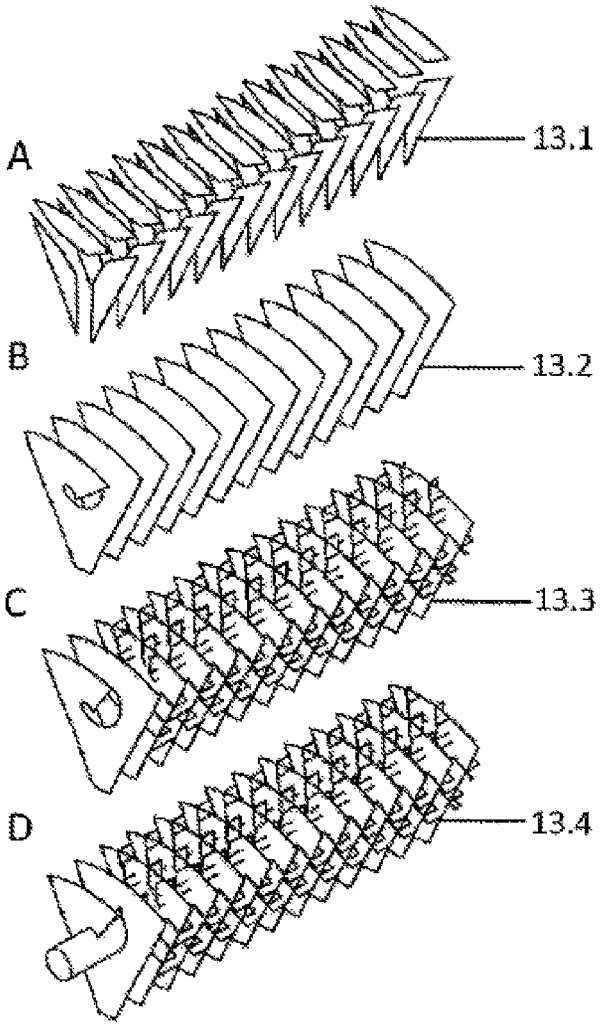
FIG. 10A-D show perspective views of the material flow control assemblies according to this invention in various embodiments that are a plurality of orderly arranged plates, a plurality of screw-like connected plates, a plurality of screw-like connected plates with paddles, a plurality of screw-like connected plates with paddles and an axial shaft, respectively.

According to this invention, each of the plurality of drying chamber enclosure walls 12 is shaped as a porous and curved rectangular wall 12.1 (as shown in FIGS. 3 and 9) on a circumference of the drying chamber assembly 3. This embodiment gives an advantage that hot gas from a hot gas inlet chamber 14 can flow into the plurality of drying chambers 9 and moist gas from the plurality of drying chambers 9 can flow out to a moist gas outlet chamber 15. This is suitable for a case when hot gas flows in a direction that is transverse with material flow direction.

Figure 11:
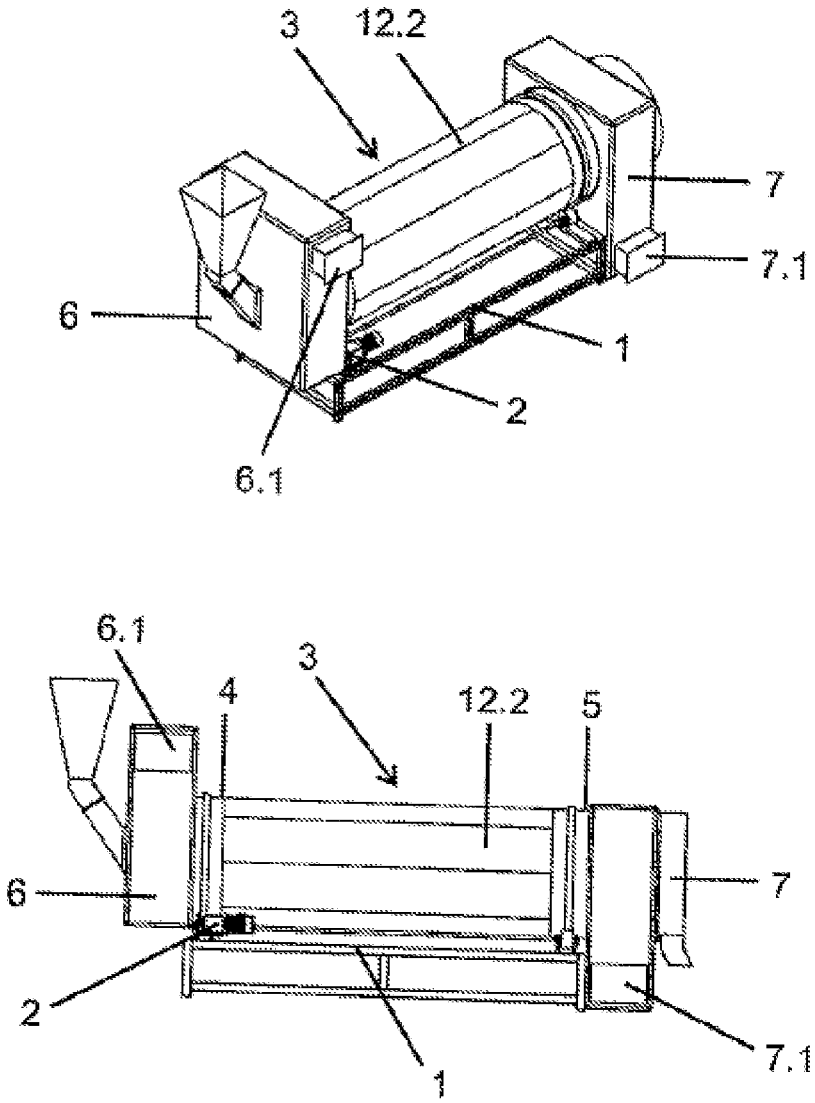
FIG. 11 shows perspective and side views of the rotary dryer with multi-drying chambers according to this invention, in an embodiment of the drying chamber enclosure walls that are the solid and curved rectangular walls and have the hot gas inlet being at the moist material inlet assembly and a moist gas outlet being at the dried material outlet assembly.

According to this invention, each of the plurality of drying chamber enclosure walls 12 is shaped as a solid and curved rectangular wall 12.2 (as shown in FIGS. 9, 11 and 12A) on the circumference of the drying chamber assembly 3, with a hot gas inlet 6.1 being at the moist material inlet assembly 6 and a moist gas outlet 7.1 being at the dried material outlet assembly 7, but without an upper housing 8.1, a hot gas inlet 8.1.1, a lower housing 8.2 and a moist gas outlet 8.2.1. This is suitable for a case when hot gas flows in a same direction or counter direction with material flow direction.

According to this invention, each of the plurality of material flow control assemblies 13 is shaped as a plurality of orderly arranged plates 13.1 (as shown in FIG. 10A) or a plurality of screw-like connected plates 13.2 (as shown in FIG. 10B) and is installed in each of the plurality of drying chambers 9 to cause material flows forward in accordance with a rotation of the drying chamber assembly 3. This embodiment gives an advantage to increase efficiency of the material flow control that can be slow-fast as desired. Also, hot gas can flow through material uniformly in accordance with material sizes that are different in their big-small, long-short and thin-thick shapes.

According to this invention, each of the plurality of material flow control assemblies (13) is shaped as a plurality of screw-like connected plates with paddles 13.3 (as shown in FIG. 10C) and is installed in each of the plurality of drying chambers (9) to cause material flows forward together with turn-over in accordance with a rotation of the drying chamber assembly 3. This embodiment gives an advantage to increase efficiency of the material flow and turn-over control that is better, hot gas can flow through material uniformly. Also, the contact surface area between hot gas and the material is increased, the moisture exchange can perform efficiently and the drying can perform rapidly.

According to this invention, each of the plurality of material flow control assemblies 13 is shaped as a plurality of screw-like connected plates with paddles and an axial shaft with stirring blades 13.4 (as shown in FIG. 10D) and is installed in each of the plurality of drying chambers 9. This is suitable for a case when hot gas flows in a same direction or counter direction with material flow direction. This embodiment gives an advantage to increase efficiency of the material flow control that is better, hot gas can flow uniformly in a same direction or counter direction with material flow direction so that the contact surface area between hot gas and the material is increased, the temperature used can be higher than that in the conventional dryer without causing damage to the dried materials, such as paddy, soybean, etc. Also, it gives an advantage to increase efficiency of the material flow control that can be slow-fast as desired in accordance with material sizes that are different in their big-small, long-short and thin-thick shapes.

Figure 4:
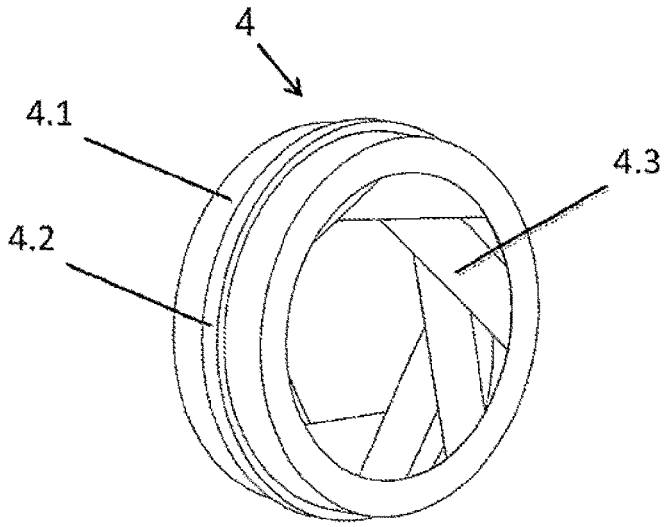
FIG. 4 shows a perspective view of the moist material inlet part of the drying chamber assembly according to this invention.
Figure 5:
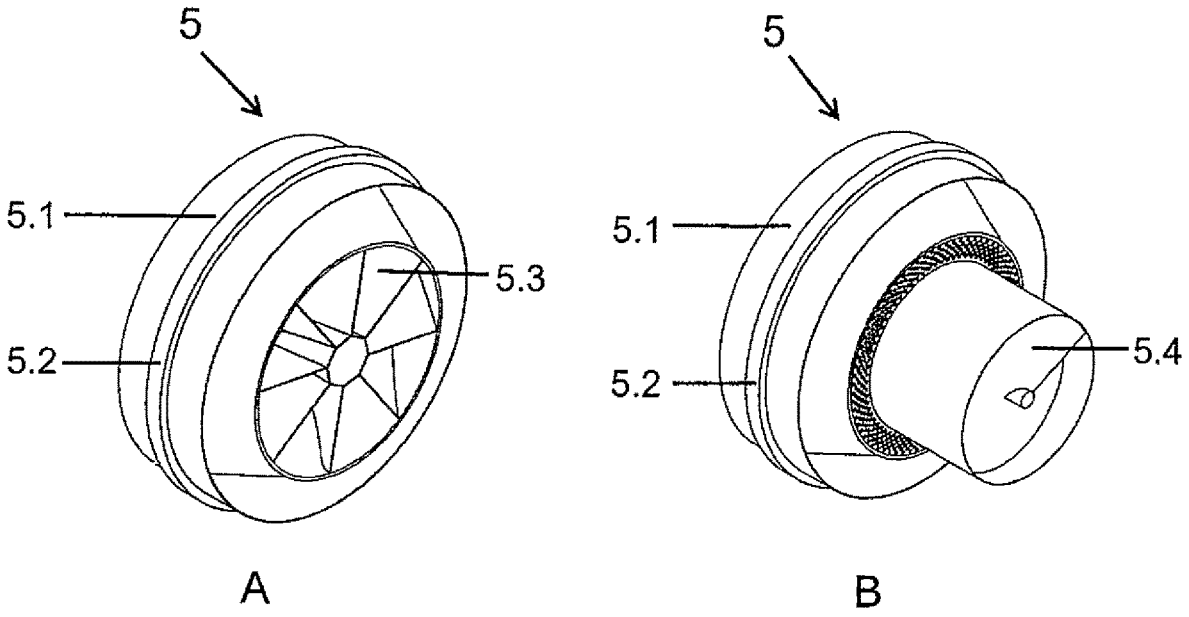
FIG. 5A-B show perspective views of the dried material outlet part of the drying chamber assembly according to this invention in various embodiments that are the embodiments with a plurality of orderly arranged blades and with a plurality of screw-like connected plates with an axial shaft, respectively.

According to this invention, the moist material inlet part 4 comprises a housing 4.1, a driving ring 4.2 and a plurality of blades 4.3 installed to the housing 4.1 (as shown in FIG. 4). This embodiment gives an advantage that when the moist material is fed to the moist material inlet assembly 6, the moist material will flow through the moist material inlet part 4 for which when it is rotated, the moist material will flow through the spaces between the plurality of blades 4.3 then flow into each chamber of the plurality of drying chambers 9 of the drying chamber assembly 3.

According to this invention, the dried material outlet part 5 comprises a housing 5.1, a driving ring 5.2 and a plurality of orderly arranged blades 5.3 installed to the housing 5.1 (as shown in FIG. 5A). This embodiment gives an advantage that when the dried material flows from the plurality of drying chambers 9 of the drying chamber assembly 3, the dried material will flow to the dried material outlet part 5 for which when it is rotated, the dried material will flow through the spaces between the plurality of dried material outlet blades 5.3 then flow into the dried material outlet assembly 7.

According to this invention, the dried material outlet part 5 comprises the dried material outlet housing 5.1, the driving ring 5.2, the plurality of orderly arranged blades 5.3 and a material flow control assembly 5.4 shaped as a plurality of screw-like connected plates with an axial shaft, installed in the housing 5.1 (as shown in FIG. 5B) suitable for a case when hot gas flows in a same direction or counter direction with material flow direction. This embodiment gives an advantage that when the dried material flows from the plurality of drying chambers 9 of the drying chamber assembly 3, the dried material will flow to the dried material outlet part 5 for which when it is rotated, the dried material will flow through the spaces between the plurality of orderly arranged blades 5.3 then flow into the material flow control assembly (5.4), then flow into the dried material outlet assembly 7. This can prevent hot moist gas from flowing into the dried material outlet assembly 7.

According to this invention, the housing (8) comprises an upper housing 8.1 covering an upper part of the drying chamber assembly 3 so as to form the hot gas inlet chamber (14) and having the hot gas inlet 8.1.1, and a lower housing 8.2 covering a lower part of the drying chamber assembly 3 so as to form the moist gas outlet chamber 15 and having the moist gas outlet 8.2.1, installed on the base frame 1 (as shown in FIGS. 1, 2, 6, 7 and 12B). This embodiment gives an advantage to increase efficiency of the hot gas flow control that hot gas can flow through material uniformly within the plurality of drying chambers 9.

Figure 12:
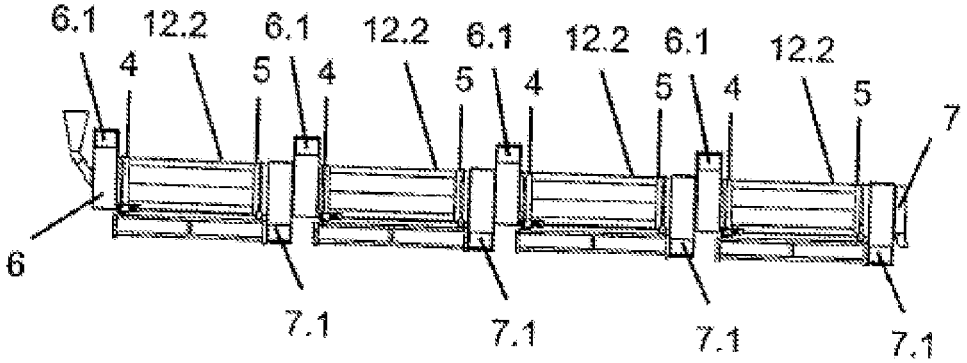
FIG. 12A-B show side views of the rotary dryers with multi-drying chambers according to this invention which are connected together in series in various embodiments that are when hot gas flows in a direction that is transverse with material flow direction and when hot gas flows in a same direction or counter direction with material flow direction.
Figure 12:
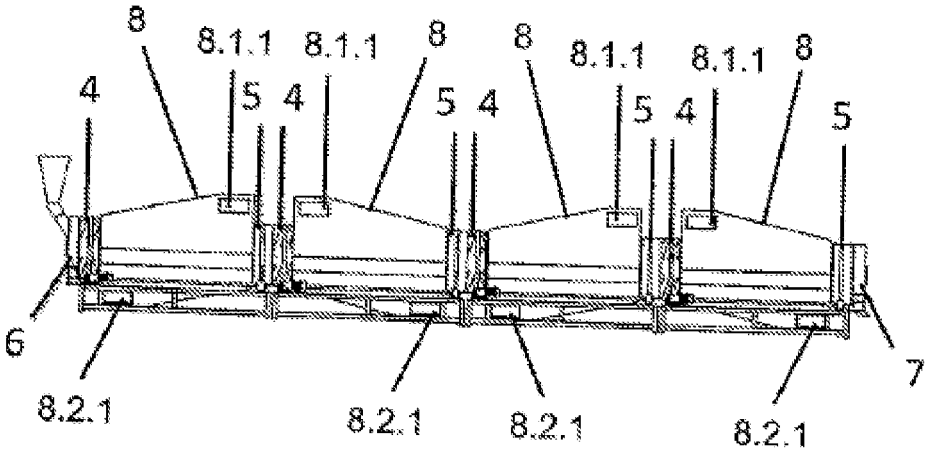

According to this invention, two or more of the rotary dryers with multi-drying chambers can be connected together in series, wherein the dried material outlet part 5 of the rotary dryer with multi-drying chambers is capped to the moist material inlet part 4 of the next rotary dryer with multi-drying chambers to cause material flow continuously from the rotary dryer with multi-drying chambers to the next rotary dryer with multi-drying chambers (as shown in FIG. 12). This embodiment gives an advantage that the material can be transferred continuously from the first rotary dryers with multi-drying chambers to the second and third rotary dryers with multi-drying chambers, so that it is able to control the drying time in each chamber of the rotary dryer with multi-drying chambers. Also, the temperature of hot gas can be controlled to be individually different in each rotary dryer with multi-drying chambers to be proper with the materials having different moisture levels and different sizes in big-small, long-short and thin-thick shapes.

Next, the operation of the rotary dryer with multi-drying chambers according to this invention will be described for clearer understanding of this invention. The rotary dryer with multi-drying chambers according to this invention has the following operation:

- Electricity is supplied to the motor 2.1 to rotate the motor and activate the drive assembly 2 in order to drive the moist material inlet part 4, the dried material outlet part 5 and the drying chamber assembly 3 to be rotated following the rotation of the drive assembly 2.
- The moist material is fed to the moist material inlet assembly 6 and flows down to the moist material inlet part 4 in accordance with the gravity force.
- The rotation of the moist material inlet part 4 cause the moist material to flow into the drying chamber assembly 3.
- The rotation of the drying chamber assembly 3 and the installation of the plurality of material flow control assembly 13 into each of the plurality of drying chambers 9 cause the material to flow forward together with turn-over of the material.
- At the same time, hot gas is fed to the hot gas inlet 8.1.1 at the upper housing 8.1, hot gas then flows to the hot gas inlet chamber 14 and flows through the plurality of drying chamber enclosure walls 12 (in case each of the plurality of drying chamber enclosure walls is shaped as a porous and curved rectangular wall 12.1 on a circumference of the drying chamber assembly 3), after that, hot gas will flow in a direction that is transverse with material flow direction to cause heat and moisture exchanging.
- Hot gas flowed through the material will turn to be moist gas with more moisture and decreased temperature, then will flow out to the moist gas outlet chamber 15 via the moist gas outlet 8.2.1 being at the lower housing 8.2.
- The material that is passed heat and moisture exchanging will be gradually dried and flows out from the drying chamber to enter the dried material outlet part 5 then flows out from the dried material outlet assembly 7 to the next process.
- In case that each of the plurality of drying chamber enclosure walls is shaped as a solid and curved rectangular wall 12.2 on a circumference of the drying chamber assembly 3, in which hot gas flows in the same direction with material flow direction. It is necessary to provide the hot gas inlet 6.1 being at the moist material inlet assembly 6 and the moist gas outlet 7.1 being at the dried material outlet assembly 7, but without the upper housing 8.1, the hot gas inlet 8.1.1, the lower housing 8.2 and the moist gas outlet 8.2.1. Hot gas will flow in the same direction with material flow direction to cause heat and moisture exchanging with the material.

Figure 8:
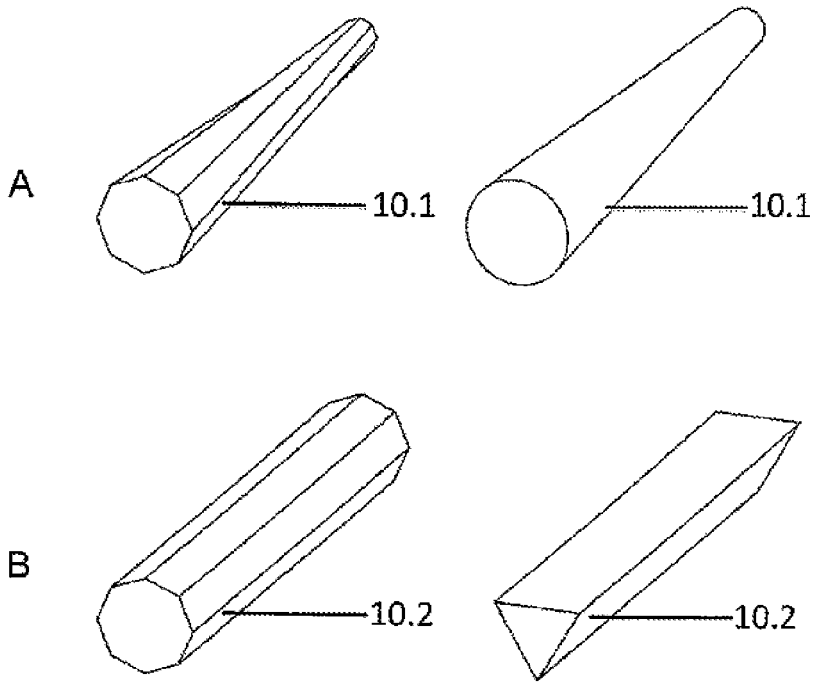
FIG. 8A-B show perspective views of the axial cores according to this invention in various embodiments that are embodiments with tapered geometry cross-sectional surface areas and with constant geometry cross-sectional surface areas, respectively.

The rotary dryer with multi-drying chambers according to this invention has no limitation to only the embodiments as described above and has no limitation to only the embodiments shown in the figures, but may be changed or modified without departing from the scope of this invention, for example, the axial core 10 having a rod shape with geometry cross-sectional surface areas as shown in FIGS. 6, 7 and 8 may be changed to have more embodiments than that shown in the said figures.

BEST MODE OF THE INVENTION

Best mode of the invention is as disclosed in the detailed description.

The invention claimed is:

1. A rotary dryer with multi-drying chambers comprising:

a base frame (1);

a drive assembly (2) installed on the base frame (1), in which the drive assembly (2) comprises a motor (2.1) and a plurality of rollers (2.2);

a drying chamber assembly (3) having a moist material inlet part (4) at one end and a dried material outlet part (5) at the other end, in which the moist material inlet part (4) and the dried material outlet part (5) are installed on the rollers (2.2) of the drive assembly (2);

a moist material inlet assembly (6) capped to the moist material inlet part (4) and installed on the base frame (1);

a dried material outlet assembly (7) capped to the dried material outlet part (5) and installed on the base frame (1); and a housing (8) encompassed the drying chamber assembly (3) and installed on the base frame (1);

characterized in that the drying chamber assembly (3) comprises a plurality of drying chambers (9) formed from an axial core (10), a plurality of drying chamber partition walls (11) installed around the axial core (10) and a plurality of drying chamber enclosure walls (12) fixed to the plurality of drying chamber partition walls (11), in which a plurality of material flow control assemblies (13) is provided in each of the plurality of drying chambers (9);

wherein each of the plurality of material flow control assemblies (13) comprises a plurality of orderly arranged plates (13.1) or a plurality of screw-shaped connected plates (13.2) and is installed in each of the plurality of drying chambers (9) to cause material flows forward in accordance with a rotation of the drying chamber assembly (3).

2. The rotary dryer with multi-drying chambers according to claim 1 wherein the axial core (10) has a rod shape with tapered geometry cross-sectional surface areas (10.1) suitable for hardly flow materials that are the materials with sheet or stick shapes, or has a rod shape with constant geometry cross-sectional surface areas (10.2) suitable for easily flow materials that are the materials with granular or spherical shapes.

3. The rotary dryer with multi-drying chambers according to claim 1 wherein the plurality of drying chambers (9) which is suitable has at least three chambers being around the axial core (10).

4. The rotary dryer with multi-drying chambers according to claim 1 wherein each of the plurality of drying chamber partition walls (11) is shaped as a rectangular wall, in which a number of the plurality of drying chamber partition walls (11) is equal to a number of the plurality of drying chambers (9).

5. The rotary dryer with multi-drying chambers according to claim 1 wherein each of the plurality of drying chamber enclosure walls (12) is shaped as a porous and curved rectangular wall (12.1) on a circumference of the drying chamber assembly (3), suitable for a case when hot gas flows in a direction that is transverse with material flow direction.

6. The rotary dryer with multi-drying chambers according to claim 1 wherein each of the plurality of drying chamber enclosure walls (12) is shaped as a solid and curved rectangular wall (12.2) on a circumference of the drying chamber assembly (3), with a hot gas inlet (6.1) being at the moist material inlet assembly (6) and a moist gas outlet (7.1) being at the dried material outlet assembly (7), suitable for a case when hot gas flows in a same direction or counter direction with material flow direction.

7. The rotary dryer with multi-drying chambers according to claim 1 wherein each of the plurality of material flow control assemblies (13) comprises a plurality of screw-shaped connected plates with paddles (13.3) and is installed in each of the plurality of drying chambers (9) to cause material flows forward together with turn-over in accordance with a rotation of the drying chamber assembly (3).

8. The rotary dryer with multi-drying chambers according to claim 1 wherein each of the plurality of material flow control assemblies (13) comprises a plurality of screw-shaped connected plates with paddles and an axial shaft with stirring blades (13.4) and is installed in each of the plurality of drying chambers (9), suitable for a case when hot gas flows in a same direction or counter direction with material flow direction.

9. The rotary dryer with multi-drying chambers according to claim 1 wherein the moist material inlet part (4) comprises a housing (4.1), a driving ring (4.2) and a plurality of blades (4.3) installed to the housing (4.1).

10. The rotary dryer with multi-drying chambers according to claim 1 wherein the dried material outlet part (5) comprises a housing (5.1), a driving ring (5.2) and a plurality of orderly arranged blades (5.3) installed to the housing (5.1).

11. The rotary dryer with multi-drying chambers according to claim 10 wherein the dried material outlet part (5), comprising the housing (5.1), the driving ring (5.2), the plurality of orderly arranged blades (5.3) and a material flow control assembly is installed to the housing (5.1), suitable for a case when hot gas flows in a same direction or counter direction with material flow direction.

12. The rotary dryer with multi-drying chambers according to claim 1 wherein the housing (8) comprising:

an upper housing (8.1) covering an upper part of the drying chamber assembly (3) so as to form a hot gas inlet chamber (14) and having a hot gas inlet (8.1.1) and a lower housing (8.2) covering a lower part of the drying chamber assembly (3) so as to form a moist gas outlet chamber (15) and having a moist gas outlet (8.2.1), installed on the base frame (1).

13. The rotary dryer with multi-drying chambers according to claim 1, wherein two or more of the rotary dryers with multi-drying chambers are connected together in series, wherein the dried material outlet part (5) of the rotary dryer with multi-drying chambers is capped to the moist material inlet part (4) of the next rotary dryer with multi-drying chambers to cause material flow continuously from the rotary dryer with multi-drying chambers to the next rotary dryer with multi-drying chambers.

* * * * *